US005143011A

United States Patent [19]

Rabbette

[11] Patent Number: 5,143,011

[45] Date of Patent: Sep. 1, 1992

[54] METHOD AND APPARATUS FOR INHIBITING BARNACLE GROWTH ON BOATS

[76] Inventor: Stephen Rabbette, 400 S. Beverly, Suite 214, Beverly Hills, Calif. 90212

[21] Appl. No.: 650,629

[22] Filed: Feb. 5, 1991

[51] Int. Cl.[5] ..... B63B 59/02

[52] U.S. Cl. ..... 114/222

[58] Field of Search ..... 114/67 R, 67 A, 222, 114/343; 204/146, 147, 148; 181/144, 148

[56] References Cited

U.S. PATENT DOCUMENTS 4,058,075 11/1977 Piper ..... 114/222
4,510,030 4/1985 Miyashita et al. ..... 204/147
4,943,954 7/1990 Ostlie ..... 114/222
5,009,757 4/1991 Riffe et al. ..... 204/147

*Primary Examiner*—Jesus D. Sotelo
*Assistant Examiner*—Stephen P. Avila
*Attorney, Agent, or Firm*—William F. Mouzavires

[57] ABSTRACT

A system for inhibiting growth of barnacles and other marine life on the hull of a boat. The system includes a plurality of transducers or vibrators mounted on the hull and alternately energized at a frequency of 25 Hertz through a power source preferably the boat battery, and a control system. The system has two selectable operating modes one being continuous and the other being periodic. Also when the voltage of the battery falls below a predetermined level, transducers are automatically de-energized to allow charging of the battery after which the transducers are energized.

21 Claims, 1 Drawing Sheet

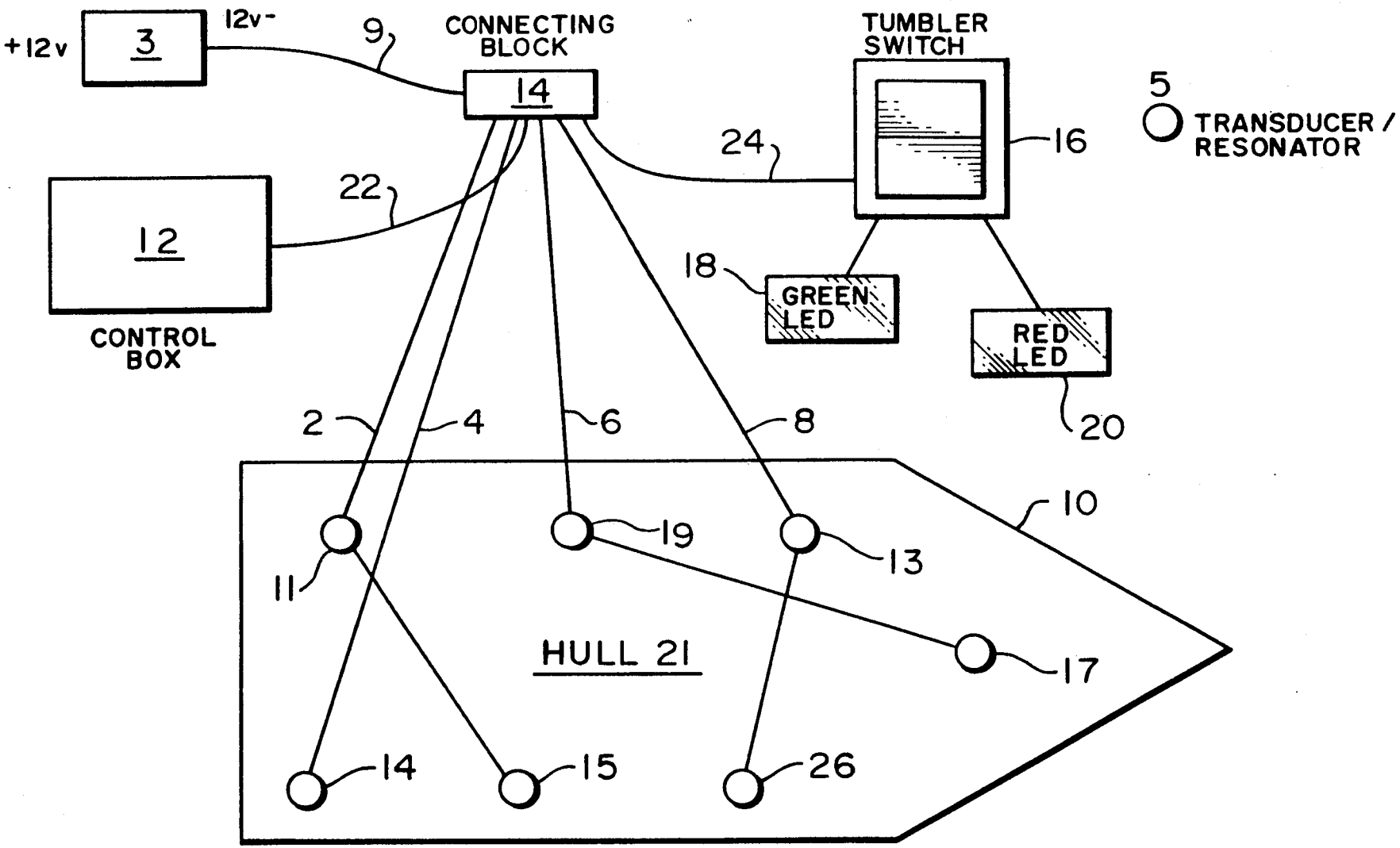
5
TRANSDUCER / RESONATOR
16
TUMBLER SWITCH
RED LED
20
GREEN LED
18
24
10
17
13
26
8
19
6
HULL 21
15
CONNECTING BLOCK
14
4
14
9
22
2
11
12v-
3
+12v
12
CONTROL BOX

METHOD AND APPARATUS FOR INHIBITING BARNACLE GROWTH ON BOATS

BACKGROUND OF THE INVENTION

The present invention generally relates to method and apparatus for preventing barnacles and other marine life from attaching to the hull of a boat.

The problem of barnacles attaching themselves to the hull of a boat has plagued man for centuries. One solution to this problem is of course to remove the boat from the water after each use; however this is very expensive and impractical and besides barnacles, though to a much lesser degree, can also grow on an object moving in the water.

Special paints for the hulls of boats have been developed to prevent barnacles and other marine life from attaching to the hull, these paints function by poisoning the life forms that come in contact with them. In general these paints are referred to as anti-fouling paints and the most popular and effective anti-fouling paint is one containing tin in the form of tributyl-tin, or T.B.T. as it is more widely known. Apparently anti-fouling paint functions by leaching toxic chemicals into the water surrounding a boat thus repelling the growth of barnacles as well as other forms of marine life. However the use of this paint obviously creates an environmental hazard affecting fish-life and in turn fish food and humans due to the toxicity of tin. Several states have now banned the use of T.B.T. as an anti-fouling agent and other countries of the world have joined in a similar ban.

After the aforementioned ban industry reverted to an anti-fouling paint containing copper which itself is a toxin. This paint had been used before the advent of T.B.T. but did not function as well. Since this paint has a relatively short effective life and since it is also toxic to a certain degree, it is not believed to be wholly satisfactory for preventing barnacle growth.

Research has been carried out over many years on the effectiveness of vibrations in controlling the problem of marine fouling on the hulls of boats. One such example is that carried out by P. V. Murphy and M. Latour of Lectret S. A. of Switzerland, and the University of Science and Technology of Languedoc, France. They reported the conclusions of their revised tests in October 1980 as follows: "High frequency vibrations of low level discourage the attachment of most fouling species. Both vegetable and animal species are affected. Additional work is required to quantify the minimum vibration levels and maximum periods of protection. Piezoelectric plastic films are effective vibration exciters especially for laminated ship hulls".

More recently research carried out by E. Sanford Branscomb and Dan Rittschaf at Duke University Marine Laboratory, North Carolina in 1983/84 found that low frequency sound waves aid in the prevention of barnacles from attaching to the hulls of boats.

The present invention is directed to the use of low frequency vibrations for preventing or inhibiting the growth of barnacles and other marine life on the hulls of boats or similar vessels.

OBJECTS OF THE PRESENT INVENTION

An object of this invention is to provide a safe and effective method and apparatus for preventing barnacles from attaching themselves to the hulls of boats. Included herein is such a method and apparatus that are in keeping with environmental laws and do not involve any toxic substances.

A further object of this invention is to provide such a method and apparatus that are easy to install and/or use while being relatively inexpensive to manufacture. Included herein are such a method and apparatus which generate vibrations of a predetermined frequency in the hull through the use of a novel system that may employ the battery of the associated vessel or boat.

SUMMARY OF THE PRESENT INVENTION

The present invention utilizes an electronic system which prevents or inhibits marine fouling on sea going vessels by establishing a vibration or resonance in the hull at a frequency level that barnacles cannot tolerate. It also discourages other marine flora and fauna. The resonance is so slight as to be imperceptible to humans and will not endanger the integrity of the hull. A plurality of resonators are mounted or attached to the hull preferably on the inside of the hull below the water line to operate at a constant frequency on the order of 25 Hertz requiring very low power (200 milliamps) and voltage (12 volts). In one mode, the system is automatically energized and de-energized periodically to save energy in those instances where the vessel's battery is employed to power the system. Preferably the system has a voltage measuring circuit for measuring the voltage of the vessel's battery and when the voltage falls below a preset amount, the system is de-energized for a predetermined period and then the system is again energized. In another mode the system is continually energized unless the voltage in the batteries is below a certain level in which case the system shuts itself off.

DRAWING

Other objects and advantages of the present invention will become apparent from the detailed description below taken in conjunction with the attached drawing which is a schematic view of a system in accordance with the present invention.

DETAILED DESCRIPTION

Referring to the drawing for illustrative purposes only, it represents a system constituting a preferred embodiment of the present invention which may be used to prevent marine-fouling on the hulls of boats through the use of vibrations.

Control box 12 drives four channels 2, 4, 6 and 8 which in turn can each drive a plurality of resonators or transducers. In the specific form shown, channel 2 includes resonators 11 and 15, channel 4 resonator 14, channel 6 resonator 19 and 17, and channel 8 resonator 13 and 26. Furthermore in the shown embodiment no more than four resonators per channel are employed. The resonators employed in the preferred embodiment of the present invention may be a dynamic transducer with wall mounted diaphragm, such as disclosed in U.S. Pat. No. 3,430,007 or a sound transducer with wall mounted diaphragm, such as disclosed in U.S. Pat. No. 3,524,027. Both of these transducers can be placed under water.

The control box 12 is normally attached to a convenient bulkhead and one wire 22 leads from it to a connecting block 14 as shown in FIG. 2.

The connecting block 14 is also attached to a convenient bulkhead and from it emanates the channels 2, 4, 6, 8, and three additional wires 9, 22 and 24. Wire 22 is connected to the control box 12. Wire 9 is connected to a 12 volt boat battery 3 although battery 3 is employed as a power source, other or permanent power sources (not shown) may also be employed. Wire 24 is connected to a tumbler switch 16. As stated, wires 2, 4, 6 and 8 emanating from the connecting block 14 are connected to the transducers and they carry a Hertz signal emanating from the control box 12 to the transducers, thus causing the surface of the hull to resonate at a desired frequency. In accordance with the present invention the signal has a predetermined constant frequency of 25 Herz which establishes resonance in the hull preventing barnacle growth and other marine fouling on the outside of the hull.

Preferably the transducers 11, 13, 14, 15, 17, 19 and 26 are epoxied to the inside of the hull 10 below the water line at approximately 10' centers 21. There can be a maximum of four transducers connected to each of the four channels 2, 4, 6 and 8 emanating from the control box 12. Not all channels 2, 4, 6 and 8 need to be used nor do there need to be a maximum of sixteen transducers (4 per line) employed for the invention to operate effectively. Reducing the number of channels, 2, 4, 6 and 8 merely increases the frequency at which a signal is sent to the resonators, 11, 13, 14, 15, 17, 19 and 26.

A tumbler switch 16 is normally installed in the control panel of the boat, and preferably it is a toggle switch having two "on" positions for controlling operation of the system. Associated with this switch, also located on the same control panel are two L.E.D. lights (light emitting diodes) of which one is red and one is green. In one "on" position the system operates continuously, shutting itself off only if the voltage of the boat's batteries drops below a predetermined level such as 11.9 volts. In the other "on" position the system operates for 12 hours and shuts off for 12 hours. If at any time during the 12 hour "on" period the boat's batteries fall below 11.9 volts the system automatically will shut itself off. The reason why the system shuts itself off is to ensure that there is always enough power to start the boat's motors. Once re-charging of the batteries starts, either from the motors or shore power, the system automatically goes into its "12 hour interrupt cycle", this allows time for the successful re-charging of the batteries before the system switches on automatically. A timer for controlling this 12 hours on and 12 hours off cycle is located in the control box 12 together with the electronics that send the 25 Herz signal intermittently to the transducers and the voltage measuring circuit. When the transducers are operating, the green L.E.D. is energized and when the transducers are de-energized, the red L.E.D. is energized.

The fixed 25 Hertz signal sent to the transducers by the system is sent sequentially, that is to say that all of the channels do not receive the 25 Herz signal at the same time. Instead, the 25 Herz signal is first sent to channel one then after a predetermined amount of time (i.e. seconds or milliseconds) the signal is sent to channel 2, then to channel 3 and so on. The fewer the channel wires used in connecting the transducers increases the frequency with which the signal is sent to the wires (i.e. The time it takes for the signal to pass from one channel wire to the next decreases in direct proportion to the number of wires used). The power requirement of the system is 200 milliamps achieved by any suitable state-of-the-art technology and by the unique feature of sending the signal to the transducers intermittently. The system operates on less than 12 volts drawing less current than a light bulb and cannot be turned off, except by disconnecting it from its power source.

It will thus be seen, the effectiveness of the system will greatly reduce the maintenance cost to both recreational and commercial boat owners. In addition the system of the invention obviates the need for toxic paints now in use to prevent marine growth or fouling.

Although a preferred embodiment of the invention has been shown and described, it will be appreciated that the invention may be incorporated in other embodiments as are covered by the claims below.

I claim:

1. Apparatus for preventing barnacle growth and other marine life from growing on the hull of boats, the apparatus comprising in combination, a plurality of transducers adapted to be connected to the hull at spaced locations, and means for alternately driving the transducers to establish a resonance in the hull at a predetermined frequency, a plurality of channels each including at least one transducer and wherein said means alternately drives the channels so that the transducer in one channel is energized while the transducer in another channel is de-energized.

2. The apparatus defined in claim 1 wherein said means drives the transducers with a frequency of on the order of 25 HZ.

3. The apparatus defined in claim 1 wherein said means drives said transducers at a constant frequency.

4. The apparatus defined in claim 3 wherein said means drives the transducers at a constant frequency of about 25 HZ.

5. The apparatus defined in claim 1 including voltage means for driving the transducers and means for de-energizing the transducers when voltage drops below a predetermined level.

6. The apparatus defined in claim 5 including a twelve volt system for driving the transducers and wherein said means for de-energizing such transducers is active to de-energize the transducers when voltage drops below about 11.9 volts.

7. The apparatus defined in claim 1 including means for automatically de-energizing said transducers after the passage of a predetermined amount of time.

8. Apparatus defined in claim 5 including means for automatically de-energizing said transducers after a predetermined amount of time has passed and means for initiating a new period of operation to run for said predetermined amount of time after the transducers have been de-energized upon a drop in voltage to said predetermined level.

9. In combination with a hull of a boat, apparatus for inhibiting growth of barnacles and other marine life on the hull, the apparatus comprising in combination, a plurality of vibrators for establishing vibration in the hull, means mounting said vibrators to the hull at a plurality of spaced locations on the hull and in groups connected in parallel to each other, and circuit means for controlling energization and de-energization of said vibrators for sequentially energizing and de-energizing said groups so that the vibrators in one group will be energized while the vibrators in another group will be de-energized.

10. The combination defined in claim 9 wherein there is included a battery for driving the boat and wherein said circuit means is energized by said battery.

11. The combination defined in claim 9 wherein said vibration is at a frequency held constant at about 25 HZ.

12. The combination defined in claim 10 further including means for automatically de-energizing said circuit means after the passage of a predetermined amount of time, means for charging said battery, and means for energizing the circuit means after the battery is charged.

13. The combination defined in claim 9 including means for automatically de-energizing said circuit means when voltage through the circuit means drops below a predetermined amount.

14. The combination defined in claim 9 including a first indicating means indicating when the vibrators are energized and a second indicating means indicating when the vibrators are de-energized.

15. A method of inhibiting the growth of barnacles and other marine life on the hulls of boats, the method comprising the steps of connecting a plurality of vibrators to the hull at locations spaced along the hull, and alternately energizing the vibrators to operate at a constant frequency to establish vibration at alternate locations in the hull and wherein said vibrators are automatically intermittently energized and de-energized at predetermined time intervals.

16. The method defined in claim 15 wherein said vibrators are energized utilizing a battery on the boat.

17. The method defined in claim 15 including the step of de-energizing the vibrators and charging a battery and then re-energizing the vibrators.

18. Apparatus for preventing barnacle growth and other marine life from growing on the hull of boats, the apparatus comprising in combination, a plurality of transducers adapted to be connected to the hull at spaced locations, and means for energizing the transducers to establish a resonance in the hull at a predetermined frequency and means for automatically interrupting energization of said transducers for a predetermined time interval and for re-energizing said transducers at the conclusion of said interval.

19. The apparatus defined in claim 18 including a plurality of channels each including at least one transducer and wherein said means alternately energizes said channels, and wherein said means includes a battery and means for automatically de-energizing the transducers when voltage of the battery falls below a predetermined level.

20. The apparatus defined in claim 19 wherein said means energizes the transducers with a frequency on the order of 25 HZ.

21. The apparatus defined in claim 18 including two operating modes, one mode providing automatically timed energization and de-energization of said transducers, and the other mode providing constant energization of said transducers.

* * * * *